US008234837B2

(12) United States Patent
Koren et al.

(10) Patent No.: US 8,234,837 B2
(45) Date of Patent: Aug. 7, 2012

(54) SPLIT COLUMNS WITH LOCATING FEATURES

(75) Inventors: Robert Douglas Koren, Cary, NC (US); David Szilezy, Apex, NC (US); Joseph Hahn, Angier, NC (US)

(73) Assignee: Column & Post, Inc., Fuquay-Varina, NC (US)

( * ) Notice: Subject to any disclaimer, the term of this patent is extended or adjusted under 35 U.S.C. 154(b) by 231 days.

(21) Appl. No.: 12/250,814

(22) Filed: Oct. 14, 2008

(65) Prior Publication Data

US 2010/0083609 A1 Apr. 8, 2010

Related U.S. Application Data

(60) Provisional application No. 61/103,052, filed on Oct. 6, 2008.

(51) Int. Cl.
*E04C 3/00* (2006.01)
*E04B 2/08* (2006.01)
*F16L 9/00* (2006.01)

(52) U.S. Cl. ..... 52/845; 52/843; 52/844; 52/832; 52/834; 52/835; 52/589.1; 138/157; 138/162

(58) Field of Classification Search ..... 52/843–845, 52/832, 834, 835, 836, 318, 589.1, 590.1, 52/590.2, 590.3, 218, 219, 169.13, 170; 138/157, 138/158, 162
See application file for complete search history.

(56) References Cited

U.S. PATENT DOCUMENTS

| | | | | | |
|---|---|---|---|---|---|
| 664,239 | A * | 12/1900 | Doane | 138/162 |
| 714,251 | A * | 11/1902 | Spencer | 138/162 |
| 760,347 | A * | 5/1904 | Petersen | 138/157 |
| 4,652,023 | A * | 3/1987 | Timmons | 285/93 |
| 5,335,471 | A * | 8/1994 | Kupiec | 52/834 |
| 5,819,468 | A * | 10/1998 | Jollie | 47/32.4 |
| 5,987,845 | A * | 11/1999 | Laronde | 52/845 |
| 6,247,500 | B1 * | 6/2001 | McMahon | 138/157 |
| 2006/0213572 | A1 * | 9/2006 | Beaulieu | 138/155 |
| 2009/0025304 | A1 * | 1/2009 | Irniger et al. | 52/40 |

* cited by examiner

*Primary Examiner* — Brian Glessner
*Assistant Examiner* — Omar Hijaz
(74) *Attorney, Agent, or Firm* — Coats & Bennett, P.L.L.C.

(57) ABSTRACT

A split column includes two half sections with locating features for aligning the half sections. A whole column is formed and then split into half sections. The locating features are formed on the inner surfaces of the half sections after the column is split into half sections.

15 Claims, 8 Drawing Sheets

SPLIT COLUMNS WITH LOCATING FEATURES

RELATED APPLICATION

This application claims the benefit of U.S. Provisional Patent Application 61/103052 filed Oct. 6, 2008, which is incorporated herein by reference.

BACKGROUND

The present invention relates generally to molded columns, and more particularly to split columns with formed locating features.

In recent years, molded columns have been used in place of wooden columns in residential construction. Molded columns have a number of advantages, such as lower costs, a variety of shapes, structural strength, etc. Various types of molding processes have been used to make columns. One technique for making molded columns is centrifugal molding. A viscous molding material is poured into an elongated mold that is spun at high speed to force the molding material against the inner surface of the mold. A second technique is using a mold that is stood on end vertically and filled from the top. This method is used by Column & Post to make square columns. A third method used is pultrusion in which multiple fiberglass strands are pulled through a resin bath and drawn through a forming die which molds the glass and resin into common column shapes. A fourth method, filament winding, involves wrapping glass strand around a turning mandrel at opposing angles until a column is formed. A fifth method is fiberglass reinforced gypsum cement or concrete columns that can be cast in a static mold or centrifugally cast.

It is frequently desirable to split columns before the columns are shipped to a customer. The columns may be split, for example, to enable the columns to be disposed around an existing wooden column. One problem with split columns is the difficulty of aligning the halves of the column at the construction site. Large columns can be extremely heavy, making it difficult for customers to properly align the halves of the column. Pultruded and filament wound columns tend to be very thin, ¼" to 3/16", and lack necessary thickness to apply adhesive to the edge for reassembly. Misalignment is a significant problem due to warping and cupping.

Split columns are also more susceptible to damage during shipment than whole columns. Columns lose some of their structural integrity after they have been split and may be damaged or break during shipment. To avoid damage to the columns during shipment, the manufacturer may not completely split the column. Instead, the manufacturer will typically leave a small amount of material connecting the halves of the column. The customer must then finish splitting the column at the construction site, which is inconvenient for the customer.

SUMMARY

The present invention relates to columns that are longitudinally split in half for assembly at a construction site. The split column according to the present invention includes two half sections with locating features for aligning the half sections of the column. The locating features are formed on an inner surface of the column. In one embodiment, the locating features include complementary groves and projections that align the surfaces of the column. In a second embodiment, the locating features comprise two aligned grooves and a locating fin that is inserted into the grooves to align the surfaces of the column. A whole column is formed and then split into half sections. The locating features are then molded in a separate molding step on the inner surfaces of the half sections after the column is split into half sections.

The locating features in the split column facilitate the alignment of the column halves at the construction site. The locating features also help to avoid damage to the columns during shipment. The half sections can be assembled together during shipment. The locating features will hold the half sections in place and prevent them from shifting during shipment.

DETAILED DESCRIPTION

Figure 1:
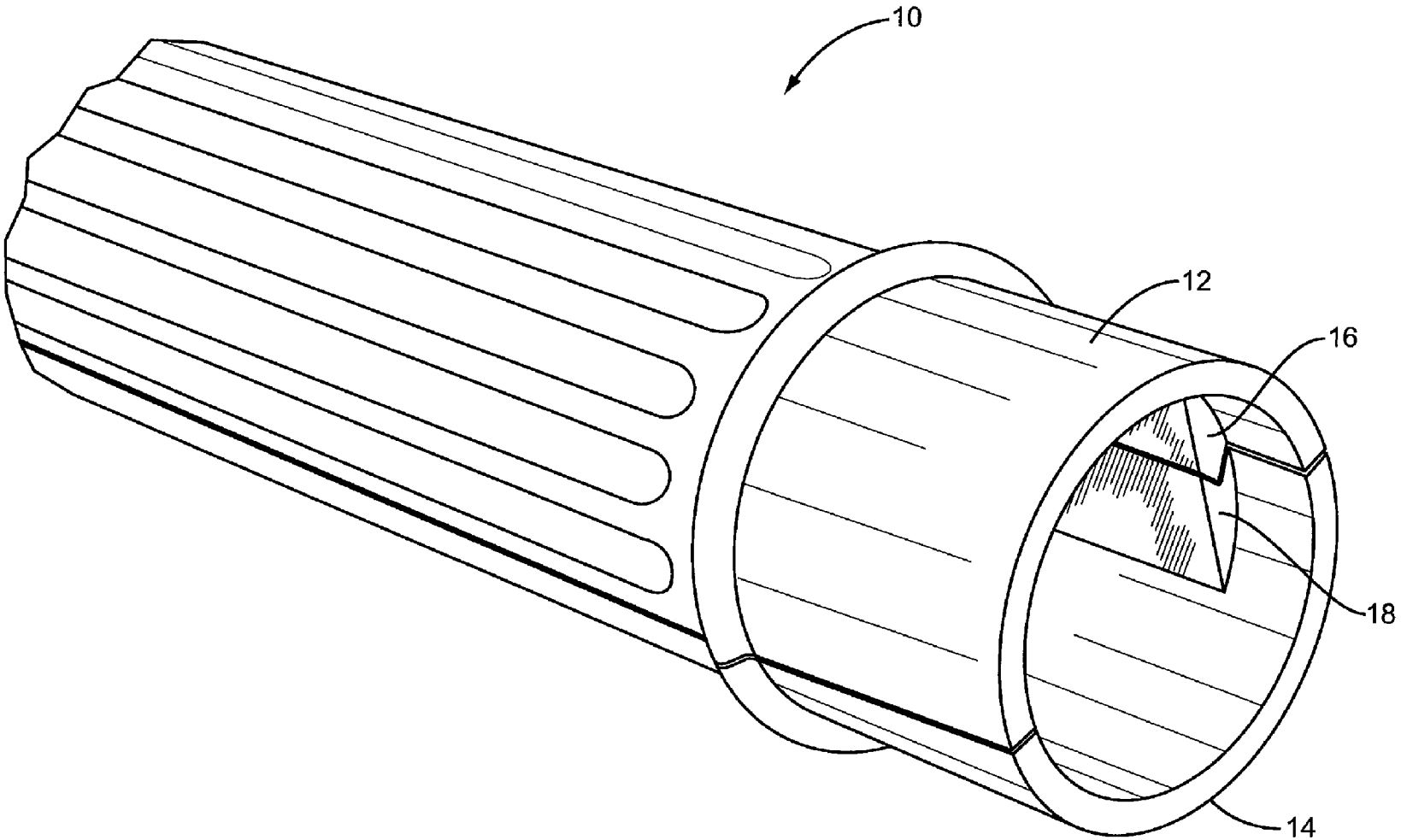
FIG. 1 illustrates in perspective an exemplary slit column with locating features according to one embodiment of the present invention.

Referring now to the drawings, FIG. 1 illustrates an exemplary split column 10 according to one exemplary embodiment of the present invention. The split column 10 includes two half sections 12, 14 which can be assembled together at the construction site. Locating features 16, 18 may be integrally formed on the inner surface of the half sections 12, 14, respectively. Alternatively, the locating features 16 and 18 may be separately formed and then secured to the inner surfaces of the column by an adhesive. The locating features 16, 18 facilitate the alignment of the half sections 12, 14 when the column is being installed at a construction site. The locating features 16, 18 also help maintain the half sections 12, 14 together when the column 10 is being shipped. Locating features 16, 18 may be formed adjacent both ends of the column 10.

Figure 2:
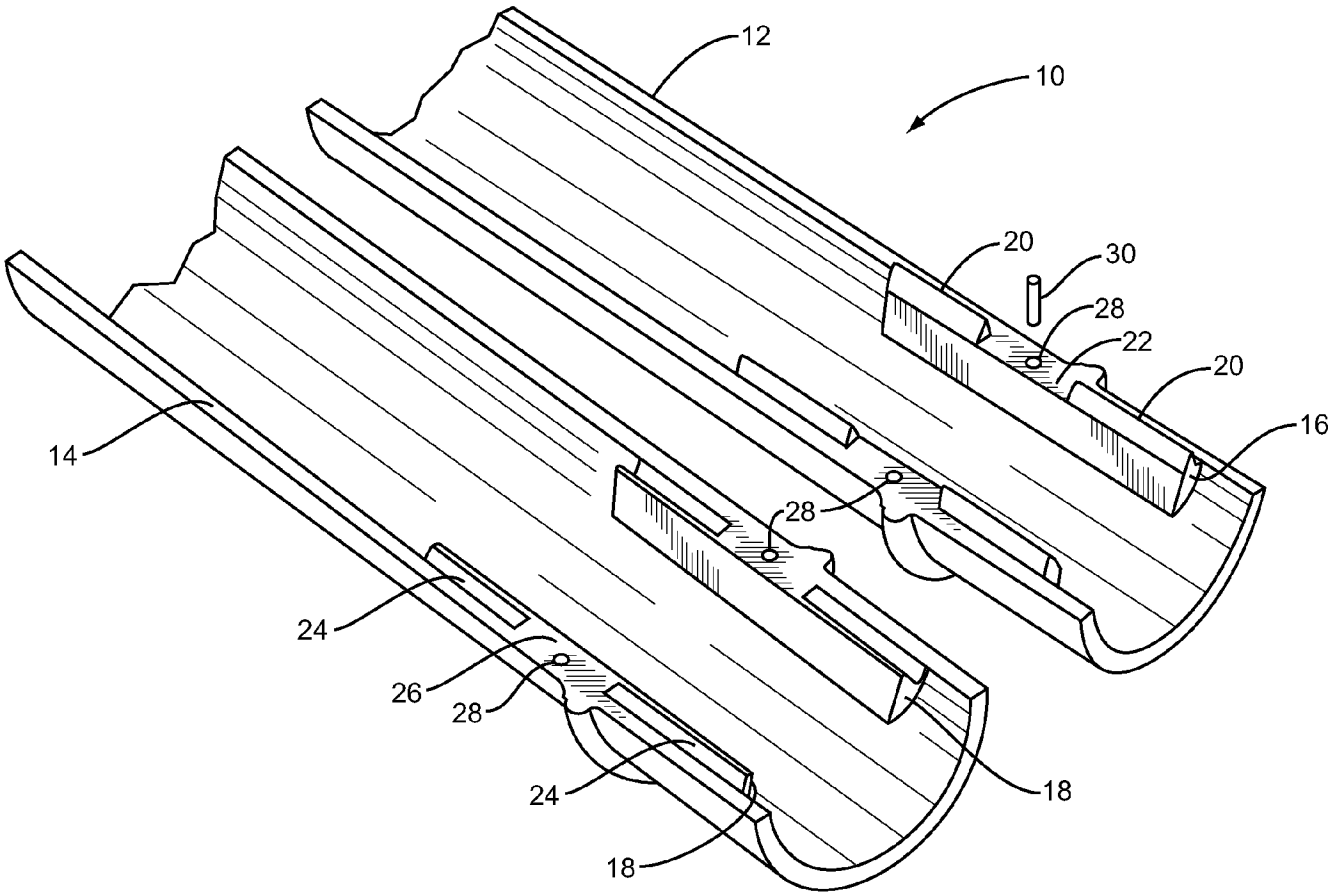
FIG. 2 illustrates in perspective the locating features of an exemplary split column.

FIG. 2 illustrates the locating features 16, 18 of the column 10 in more detail. Locating feature 18 includes two V-shaped grooves 24. The V-shaped grooves 24 are longitudinally spaced and separated by a flat area 26. The locating feature 16 on half section 12 includes two V-shaped projections 20 that mate with the V-shaped grooves in locating feature 16. The V-shaped projections 20 are longitudinally spaced and separated by a flat area 22. Flat areas 22 and 26 are flush with the edges of the column halves 12, and 14. Flat areas 22 and 26 are flush with the edges of the column halves 12, and 14 and may optionally include dowel holes 28. Fluted or ribbed dowels 30 fit snugly into the dowel hole 28 and help to hold the column halves 12 and 14 together.

The configuration of the locating features 16, 18 provide alignment in two dimensions. First, the locating features 16, 18 align the half sections 12, 14 laterally so that the edges of the half sections abut. Additionally, the locating features 16, 18 provide vertical alignment of the half sections 12, 14. The vertical alignment is due to the fact that the half sections 12, 14 will not come together unless the projections 20 on the locating feature 16 vertically align with the grooves 24 of the locating feature 18.

The locating features 16, 18 make assembly of the column 10 more manageable. Large columns 10 can be extremely heavy. Without the locating features 16, 18 it would be difficult to properly align the half sections 12, 14. Additionally, the locating features 16, 18 prevent the half sections 12, 14 from shifting during shipment of the columns 10, thus avoiding damage to the columns 10.

The production of the columns 10 is essentially a three step process. The first step in the production process is molding the columns 10. The columns 10 may be molded using a centrifugal molding process as known in the art. The second step in the process is splitting the column 10 into two half sections 12, 14. The columns 10 may be split, for example, by feeding the column through a band saw. The third step in the process is forming the molding features 16 and 18 on the inner surfaces of the column 10. The locating features 16, 18 are formed by a separate secondary molding process after the column 10 has been split into half sections 12, 14.

Figure 3:
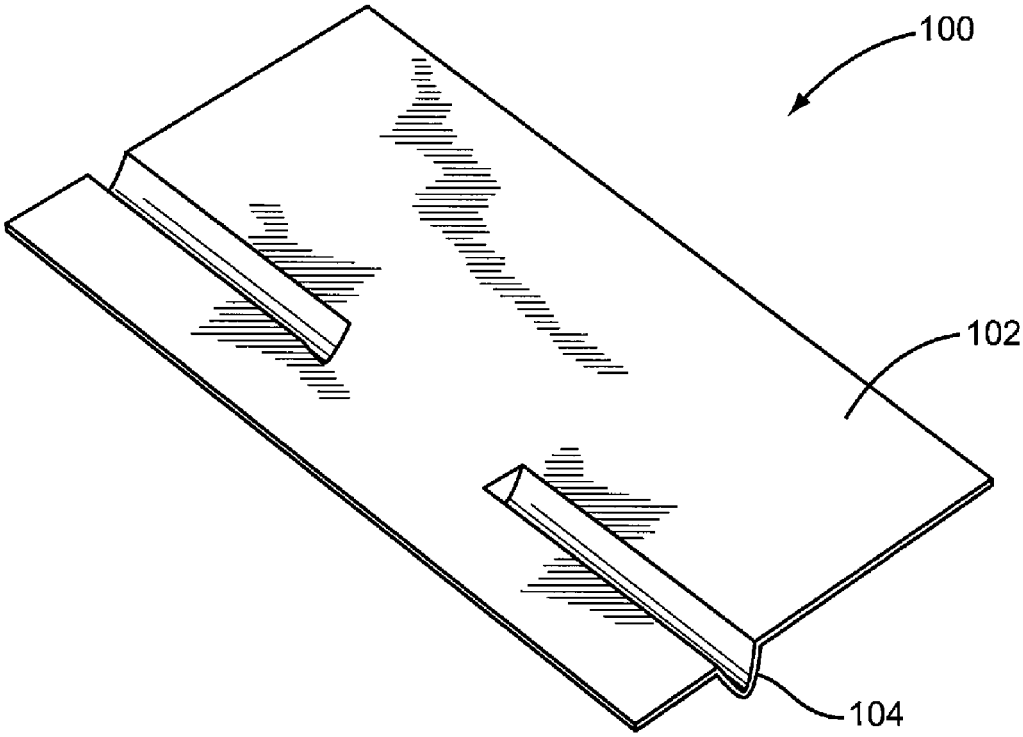
FIG. 3 illustrates an exemplary mold for forming the locating features in the split column.

FIG. 3 illustrates an exemplary mold 100 that is used to form the locating features in the half sections 12, 14. The mold 12 comprises a flat molding plate 102 with two triangular forms 104. The triangular forms 104 are separated by a flat area. The ends of the triangular forms 104 adjacent the flat area are closed. The mold 100 can be made from sheet metal, plastic, or other suitable materials.

Figure 4:
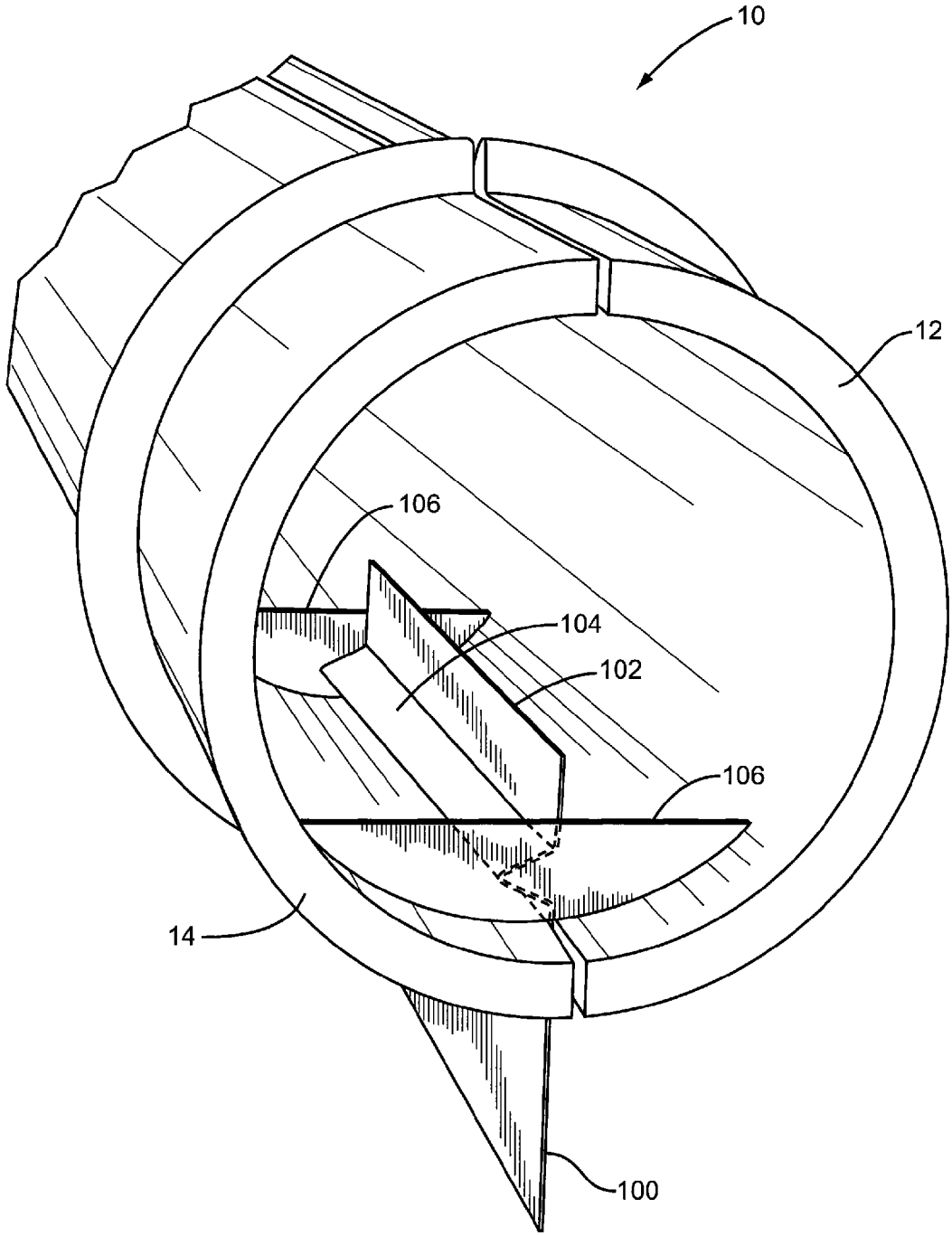
FIG. 4 illustrates in perspective the interior of a split column with the mold in place for forming locating features.
Figure 5:
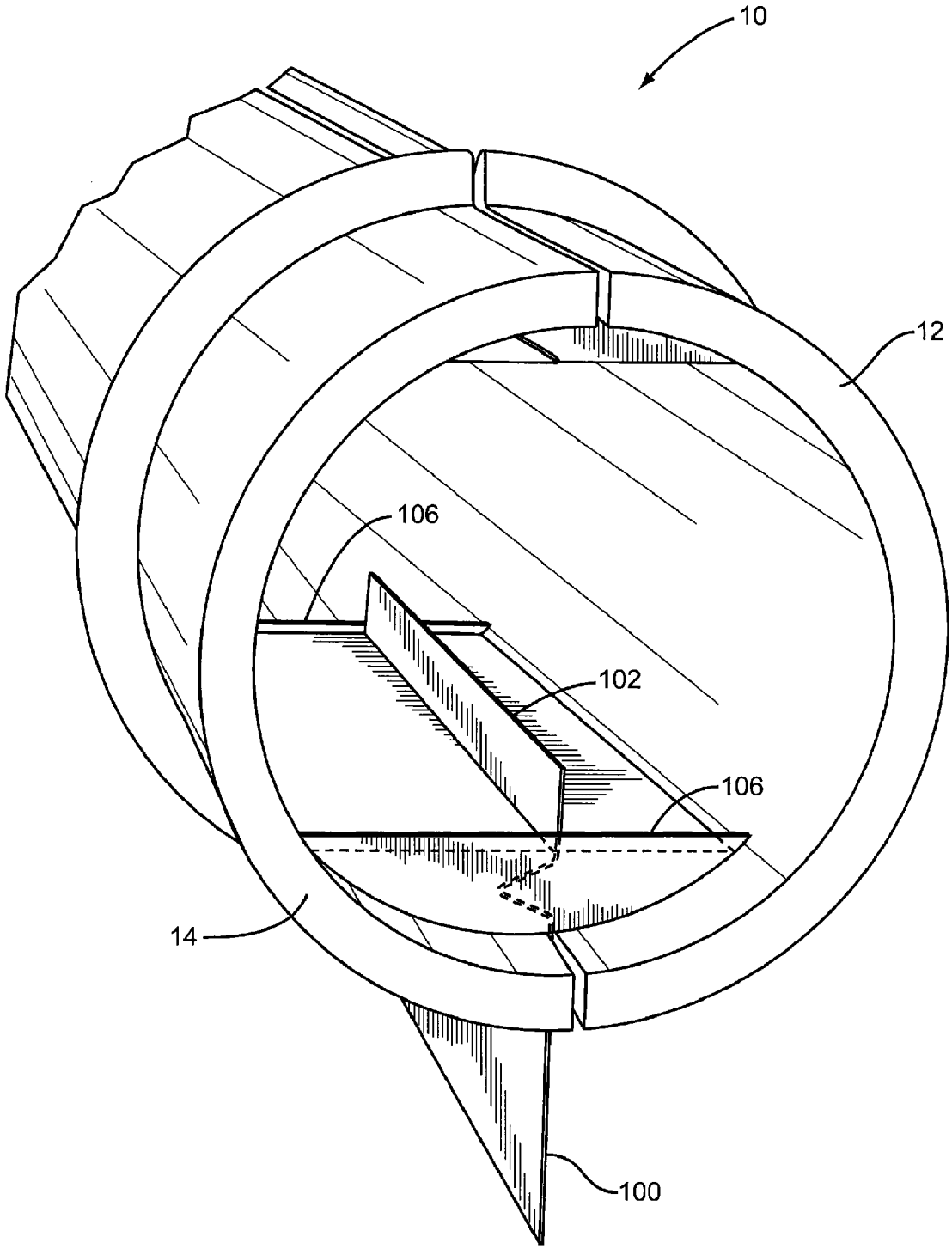
FIG. 5 illustrates in perspective the interior of a split column with the mold in place for the locating features being formed.

Referring to FIGS. 4 and 5, mold 100 is used to simultaneously form the locating features 16, 18 on the interior surfaces of half sections 12, 14, respectively. The mold 100 is interposed between the half sections 12, 14 as shown in FIG. 4. End plates 106 shaped to match the curvature of the column 10 are disposed at opposite ends of the mold 100. Putty can be used to hold the end plates 106 in place. A molding material is then poured into the space formed between the end plates 106 on both sides of the mold 100 as shown in FIG. 5. Care should be taken to prevent the molding material from flowing over the top edges of the end plates 106. Once the molding material sets, the half sections 12, 14 are separated and the mold 100 is removed. The column 10 is then rotated 180° to form the locating features 16, 18 on the other side.

Figure 6A:
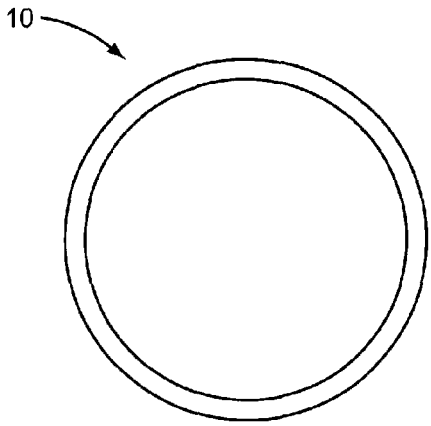
FIG. 6A-6F illustrate and exemplary molding process for forming locating features in a split column.
Figure 6B:
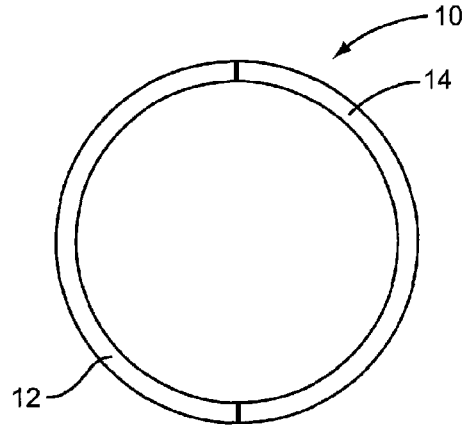
Figure 6C:
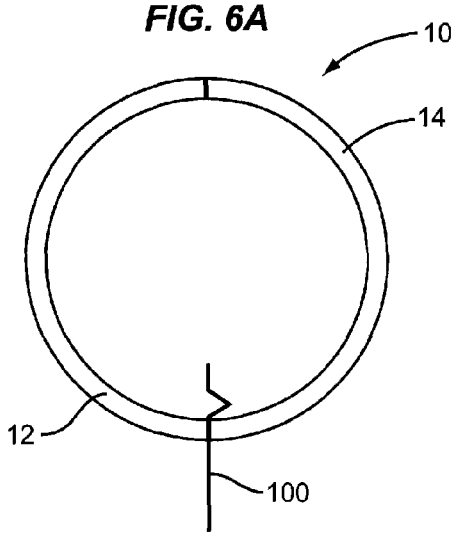
Figure 6D:
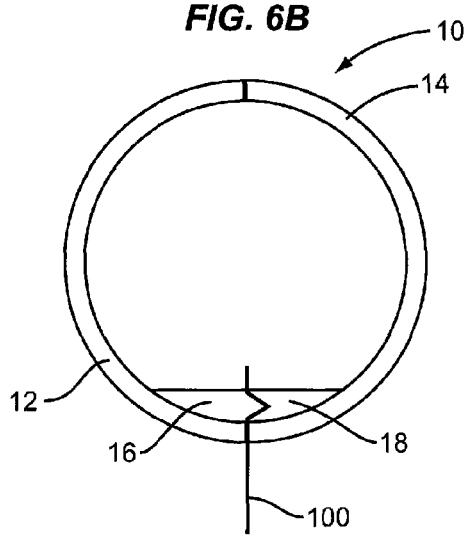
Figure 6E:
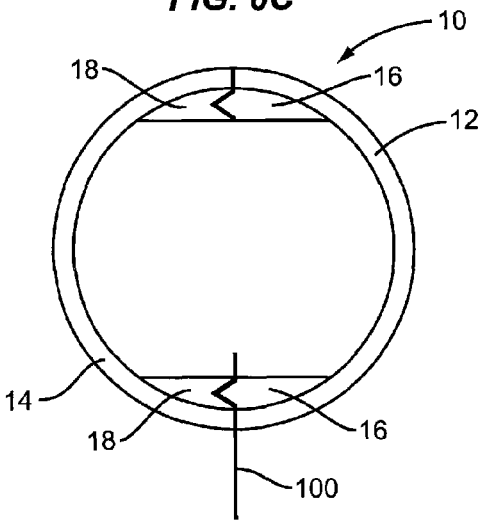
Figure 6F:
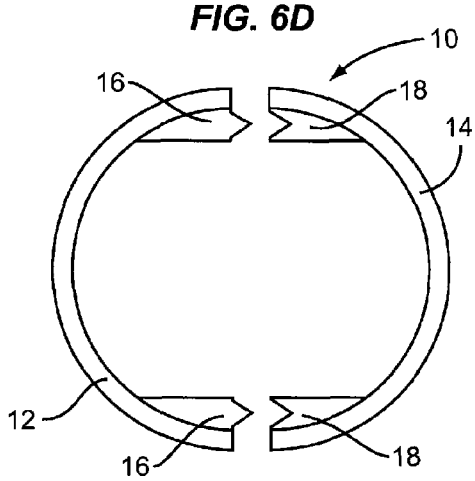

FIGS. 6A-6F illustrate exemplary process steps for forming the column 10. A whole column 10 is formed (FIG. 6A) and then split into two half sections 12, 14 (FIG. 6B). The mold is interposed between the half sections 12, 14 and the column is rotated so that the part line is vertical (FIG. 6C). Locating features 16, 18 are then formed on one side of the column (FIG. 6D). After the first set of locating features 16, 18 are formed, the column is rotated 180° and similar locating features 16, 18 are formed on the opposite of the column (FIG. 6E). FIG. 6F shows the column 10 with locating features 16, 18 formed on both sides.

Figure 7:
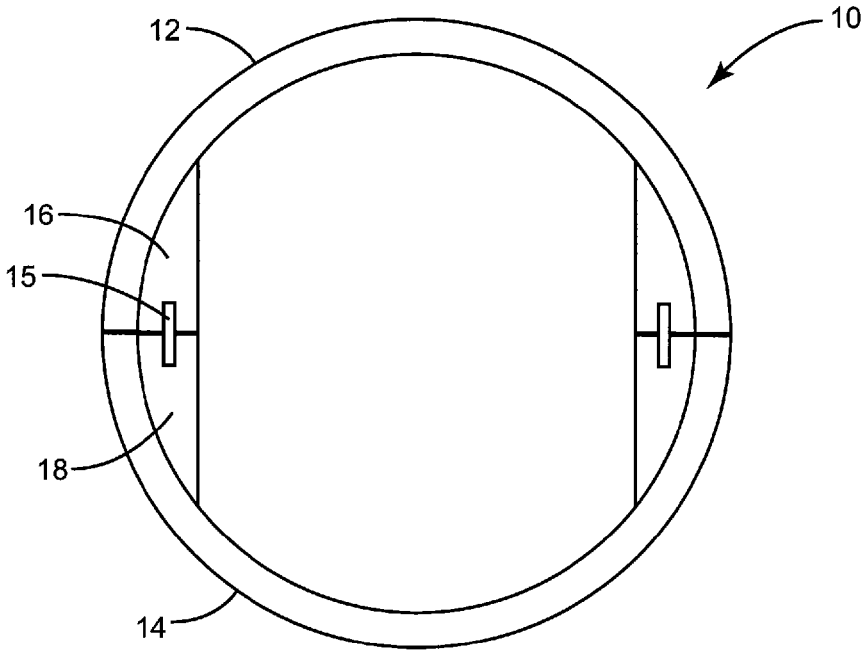
FIG. 7 is a section view of a column according to a first alternate embodiment.
Figure 8:
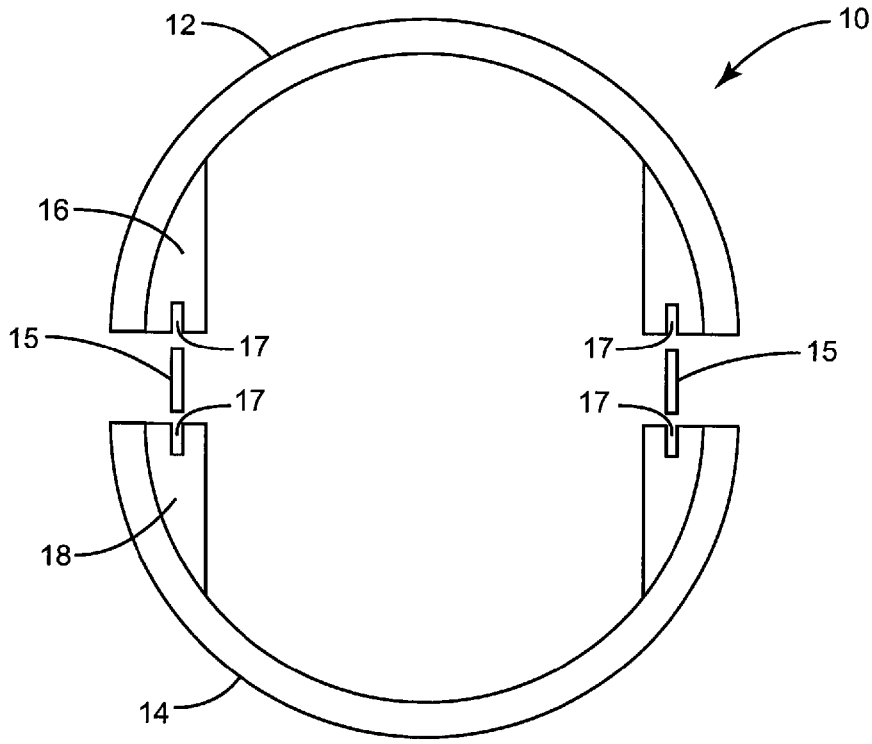
FIG. 8 is an exploded section view of a column according to a first alternate embodiment.

FIGS. 7 and 8 illustrate an alternative embodiment of the invention. In this embodiment, the column 10 is split longitudinally into two half sections 12 and 14 as previously described. In this embodiment, the locating features 16 and 18 both include narrow slots 17. A fin or disc 15 fits into the slots 17 of the locating features 16 and 18 to align the surfaces of the column 10.

Figure 9:
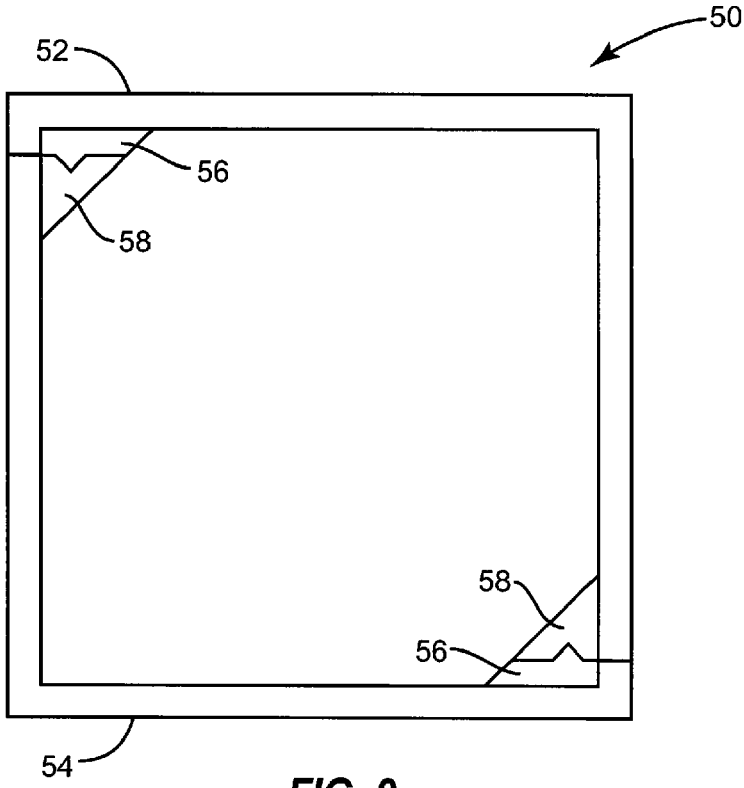
FIG. 9 is a section view of a column according to a second alternate embodiment.
Figure 10:
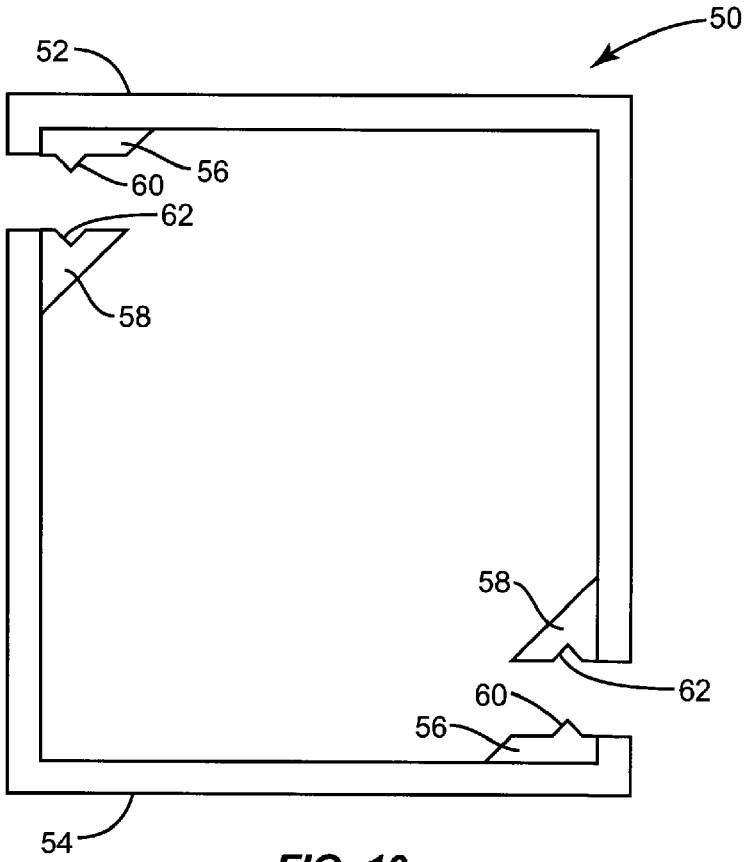
FIG. 10 is an exploded section view of a column according to a second alternate embodiment.

FIGS. 9 and 10 illustrates an exemplary square column 50 with two half sections 52 and 54. In this embodiment, each half section 52, 54 includes two locating features 56 and 58 respectively. Locating feature 56 includes a projection 60 while locating feature 58 includes a complementary groove 62. Locating feature 56 on half section 52 mates with locating feature 58 on half section 54, while locating feature 58 on half section 52 mates with the locating feature 56 on half section 54. Thus, each half section 52, 54 includes both male and female locating features.

The present invention may, of course, be carried out in other specific ways than those herein set forth without departing from the scope and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A split column comprising:

a first half section;

a second half section; and first and second locating features formed on respective inner surfaces of the first and second half sections to structurally facilitate alignment of the first and second half sections;

wherein the first locating feature comprises at least one groove defined between the inner surface of the first half section and a wall extending from that inner surface at a non-normal angle, and wherein said first and second locating features have complementary configurations.

2. The split column of claim 1 wherein the second locating feature comprises at least one complementary projection configured to fit in said groove when the first and second half section are aligned.

3. The split column of claim 1 wherein the first and second locating features are configured to vertically align the half sections.

4. The split column of claim 3 wherein the first locating feature comprises a plurality of longitudinally spaced grooves, and wherein the second locating feature comprises a plurality of longitudinally spaced projections that fit into the longitudinally spaced grooves.

5. The split column of claim 4 wherein the first and second locating features each further include at least one dowel hole for receiving a dowel pin.

6. The split column of claim 5 wherein at least one dowel hole is disposed between two of said plurality of longitudinally spaced grooves in the first locating feature and at least one dowel hole is disposed between two of said plurality of longitudinally spaced projections on the second locating feature.

7. The split column of claim 4 wherein said plurality of longitudinally spaced grooves and said plurality of longitudinally spaced projections are longitudinally extending and have defined longitudinal boundaries on the grooves' and projections' respective locating features, the longitudinal boundaries of the grooves and projections being spaced from an outer surface of the grooves' and projections' respective half section and being spaced from an inner surface of the grooves' and projections' respective locating feature.

8. The split column of claim 1 wherein said first and second locating features facilitate alignment of the first and second half sections to form a press fit connection.

9. The split column of claim 1 wherein said first and second locating features define a longitudinally extending chordal planar surface within the split column when said first and second half sections are aligned by said first and second locating features.

10. The split column of claim 1, wherein edges of the first and second half sections are configured to abut in a non-interlocking manner when the first and second half sections are aligned.

11. The split column of claim 1, wherein the first and second locating features structurally preclude edges of the first and second half sections from abutting unless the first and second half sections are aligned.

12. The split column of claim 1, wherein the second locating feature comprises at least one complementary projection that extends past an edge of the second half section and that is configured to fit in said at least one groove when the half sections are aligned, and wherein the first locating feature also comprises at least one flat area that is vertically adjacent to the at least one groove, that is flush with an edge of the first half section, and that is configured to engage the at least one complementary projection, and thereby preclude the edges of the first and second half sections from abutting, when the at least one complementary projection is not vertically aligned with the at least one groove.

13. The split column of claim 1, wherein the first and second locating features are formed proximal to ends of the first and second half sections.

14. The split column of claim 1, wherein said wall extends from the inner surface of the first half section towards the second half section when the first and second half sections are aligned.

15. The split column of claim 1, wherein the first locating feature is formed proximal to an edge of the first half section, and wherein said wall extends from the inner surface of the first half section towards that edge.

* * * * *